US007059142B2

(12) United States Patent
Jeong et al.

(10) Patent No.: US 7,059,142 B2
(45) **Date of Patent: *Jun. 13, 2006**

(54) REFRIGERATOR HAVING TEMPERATURE CONTROLLED CHAMBER

(75) Inventors: Gi Joong Jeong, Kwangju (KR); Jong Dal Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/670,263

(22) Filed: Sep. 26, 2003

(65) Prior Publication Data

US 2004/0144127 A1 Jul. 29, 2004

(30) Foreign Application Priority Data

Jan. 24, 2003 (KR) ..... 10-2003-0004860

(51) Int. Cl.
*F25D 17/04* (2006.01)
*F25D 11/02* (2006.01)

(52) U.S. Cl. ..... 62/186; 62/441; 62/408

(58) Field of Classification Search ..... 62/186, 62/89, 441, 408
See application file for complete search history.

(56) References Cited

U.S. PATENT DOCUMENTS

| | | | | |
|---|---|---|---|---|
| 4,689,966 | A * | 9/1987 | Nonaka | 62/187 |
| 4,732,009 | A * | 3/1988 | Frohbieter | 62/89 |
| 4,732,014 | A * | 3/1988 | Frohbieter | 62/382 |
| 6,260,362 | B1 | 7/2001 | Choi | |
| 2005/0016202 | A1 * | 1/2005 | Ko et al. | 62/441 |

FOREIGN PATENT DOCUMENTS

EP 849553 A2 * 6/1998

* cited by examiner

*Primary Examiner*—Chen Wen Jiang
(74) *Attorney, Agent, or Firm*—Staas & Halsey LLP

(57) ABSTRACT

A refrigerator having a temperature controlled chamber partitioned from a refrigerator compartment and a freezer compartment. Air is circulated between the freezer compartment and the temperature controlled chamber through air inlet and outlet ports, thus cooling the temperature controlled chamber. An intake damper is installed in the air inlet port, and a fan is mounted at a rear portion of the temperature controlled chamber. The intake damper has a thin plate, thus opening the air inlet port in response to the air flowing into the temperature controlled chamber when the cooling fan is operated, and closing the air inlet port in response to a stoppage of flow of the air when the cooling fan stops. Further, a temperature sensor is mounted in the temperature controlled chamber to control operation of the fan, thus allowing an interior of the temperature controlled chamber to be maintained at a predetermined temperature.

17 Claims, 5 Drawing Sheets

REFRIGERATOR HAVING TEMPERATURE CONTROLLED CHAMBER

CROSS-REFERENCE TO RELATED APPLICATIONS

This application claims the benefit of Korean Application No. 2003-4860, filed Jan. 24, 2003, in the Korean Intellectual Property Office, the disclosure of which is incorporated herein by reference.

BACKGROUND OF THE INVENTION

1. Field of the Invention

The present invention relates, in general, to refrigerators and, more particularly, to a refrigerator, which is provided in a refrigerator compartment thereof, with a temperature controlled chamber, which is maintained at a predetermined temperature using cool air of a freezer compartment, thus allowing food items to be stored at a predetermined temperature between a temperature of the refrigerator compartment and a temperature of the freezer compartment.

2. Description of the Related Art

As is well known to those skilled in the art, a refrigerator is an appliance that stores various kinds of food items for a lengthy period of time, by supplying cool air from an evaporator to a freezer compartment and a refrigerator compartment, to maintain the freshness of the food items. The freezer compartment is used for storing food items which must be maintained below the freezing temperature, such as meat, fish, and ice cream. And the refrigerator compartment is used for storing food items which must be maintained at a low temperature above the freezing temperature, such as vegetables, fruits, and various kinds of beverages.

Recently, a preference for a large-capacity refrigerator has increased, because a large quantity of foods is stored in the large-capacity refrigerator, thus providing convenience to a consumer. The large-capacity refrigerator has a side-by-side structure, which is provided on its left side with a freezer compartment and on its right side with a refrigerator compartment. The refrigerator compartment and the freezer compartment are provided with a plurality of shelves and drawers to easily store a large quantity of foods in the refrigerator.

Thus, the refrigerator compartment stores vegetables and fruits at a low temperature above the freezing temperature to keep the vegetables and fruits fresh without freezing them. Meanwhile, the freezer compartment freezes and stores perishable meat or fish, thus allowing the meat or fish to be preserved for a lengthy period of time.

When one desires to cook meat or fish stored in the freezer compartment, the meat or fish must be thawed for a lengthy period of time because the meat or fish stored in the freezer compartment are frozen.

Thus, in preparation for cooking meat or fish after storing them in the freezer for a while, it is desirable for the meat or fish to not be completely frozen, to therefore be easily and rapidly cooked. The conventional refrigerator has only the refrigerator compartment which is maintained at a temperature above the freezing temperature, in addition to the freezer compartment. But, the refrigerator compartment is not cold enough to be suitable for storing the meat or fish.

Further, the conventional refrigerator has a problem that the refrigerator compartment is frequently opened and closed, so an interior of the refrigerator compartment is not maintained at a proper temperature and a temperature variation thereof is undesirably great, thus not maintaining the freshness of meat or fish stored therein without a thawing process.

SUMMARY OF THE INVENTION

Accordingly, it is an aspect of the present invention to provide a refrigerator having a temperature controlled chamber, which maintains the freshness of food, such as meat or fish, and stores the food so that the food can be immediately cooked without the necessity of thawing the food.

The foregoing and/or other aspects of the present invention are achieved by providing a refrigerator, with a refrigerator compartment maintained at a predetermined refrigerator temperature, a freezer compartment maintained at a predetermined freezer temperature, a temperature controlled chamber provided in the refrigerator compartment, partitioned from the refrigerator compartment, a cool air inlet port to introduce cool air from the freezer compartment into the temperature controlled chamber, and a cool air outlet port to discharge the cool air from the temperature controlled chamber into the freezer compartment.

According to one aspect, the temperature controlled chamber has a rear insulation wall, upper and lower insulation walls, and side insulation walls, and is opened at its front. A drawer for storing food items is is movable through the open front of the temperature controlled chamber.

According to one aspect, the refrigerator compartment and the freezer compartment are partitioned from each other by a vertical partition wall arranged between the refrigerator and freezer compartments. The cool air inlet port and the cool air outlet port are located in the vertical partition wall so that the cool air is circulated between the freezer compartment and the temperature controlled chamber through the air inlet and outlet ports, thus cooling the temperature controlled chamber.

According to one aspect, an intake damper is installed in the cool air inlet port to open and close the cool air inlet port.

According to one aspect, a cooling fan is positioned adjacent to the cool air inlet port, thus allowing the cool air to be forcibly circulated from the freezer compartment to the temperature controlled chamber.

According to one aspect, the intake damper has a thin plate, thus opening the cool air inlet port in response to the cool air flowing into the temperature controlled chamber when the cooling fan is operated, and closing the cool air inlet port in response to a stoppage of flow of the cool air when the cooling fan is stopped.

According to one aspect, a temperature sensor is mounted in the temperature controlled chamber to control operation of the cooling fan, thus allowing an interior of the temperature controlled chamber to be maintained at a preset temperature.

Additional aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Figure 1:
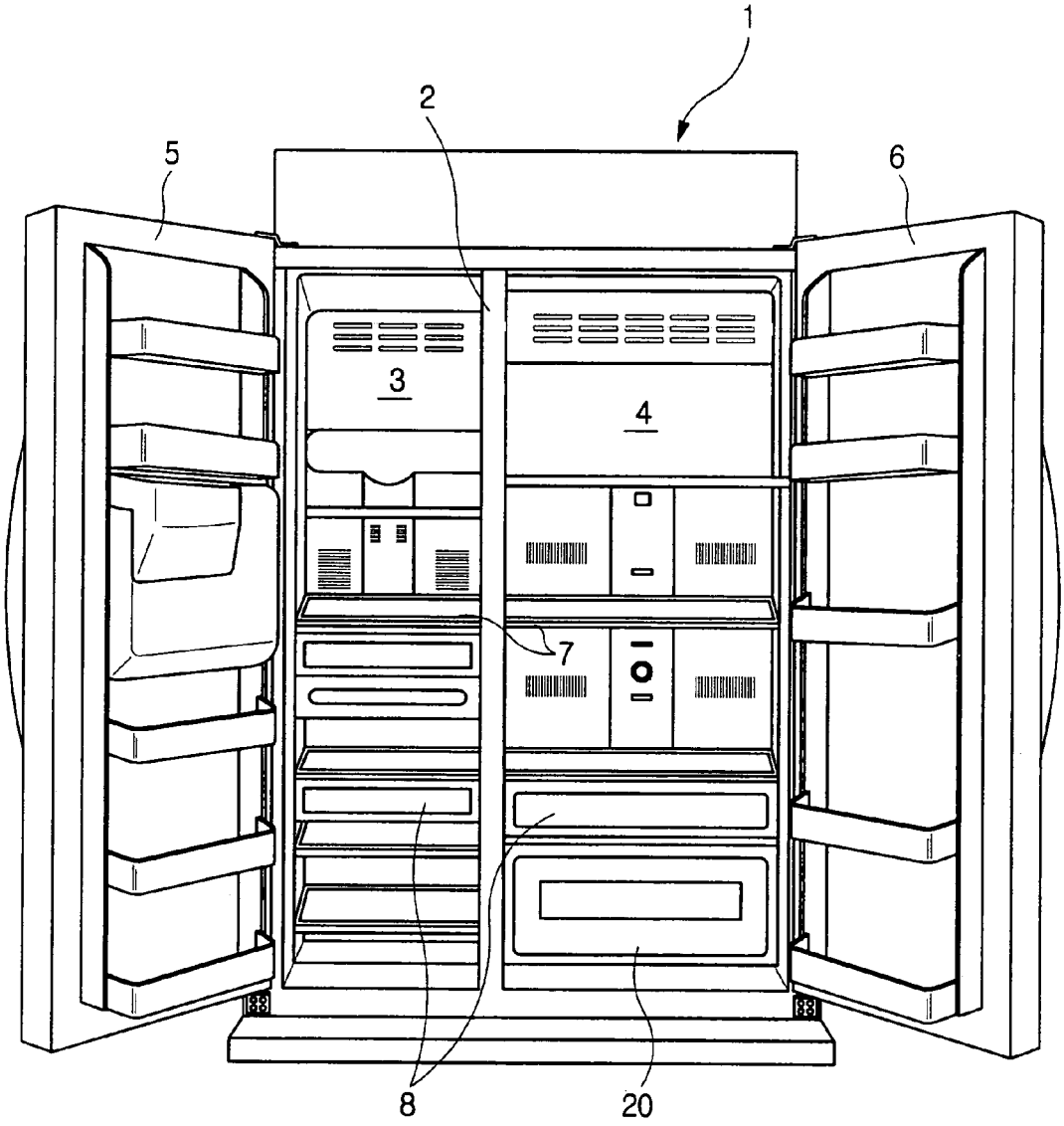
FIG. 1 is a view of a refrigerator, according to an embodiment of the present invention.

Reference will now be made in detail to embodiments of the present invention, examples of which are illustrated in the accompanying drawings, wherein like reference numerals refer to like elements throughout. The embodiments are described below to explain the present invention by referring to the figures.

Figure 2:
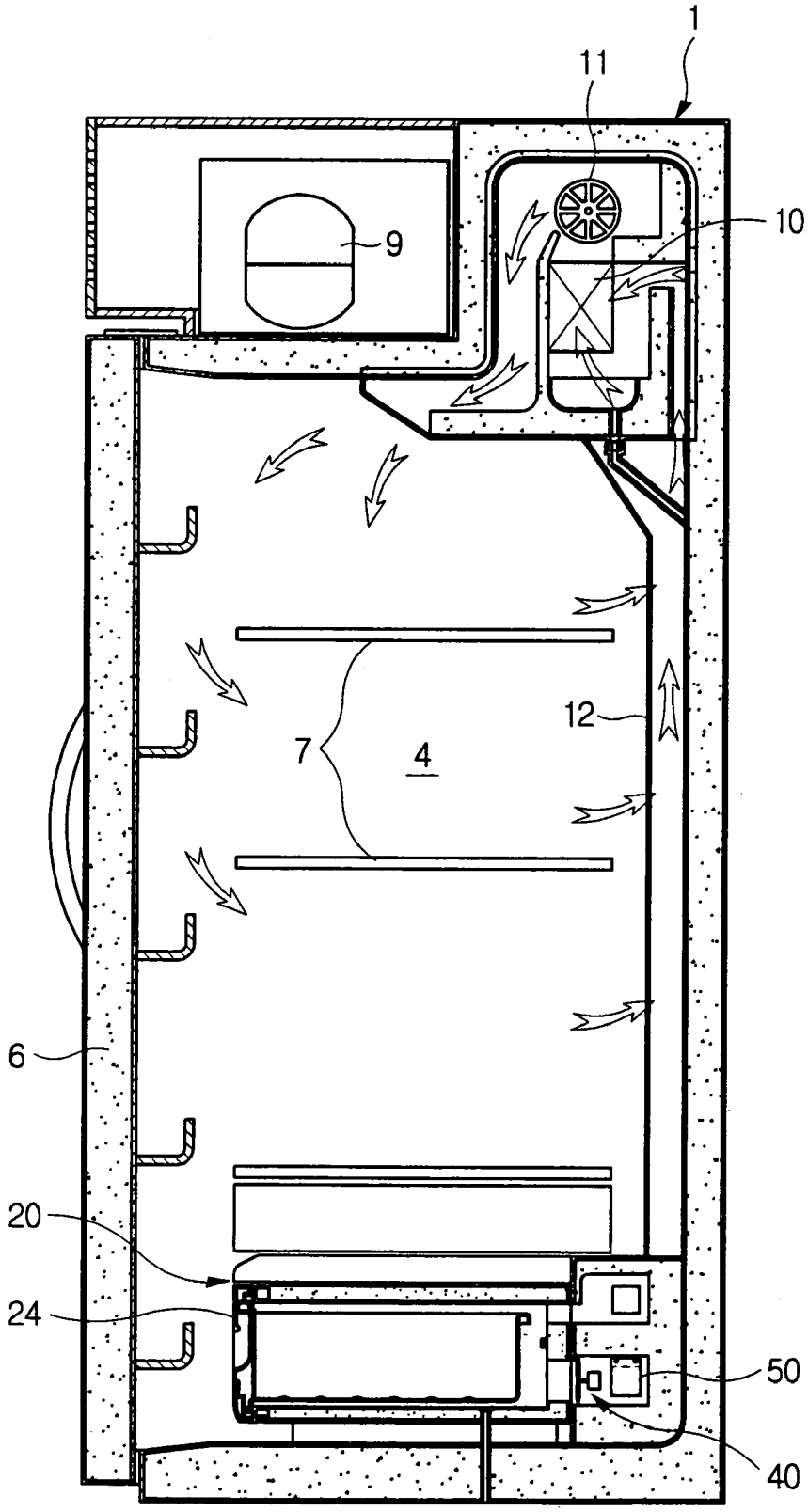
FIG. 2 is a sectional view of the refrigerator of FIG. 1.

FIG. 1 is a view of a refrigerator, according to the present invention. FIG. 2 is a sectional view of the refrigerator of FIG. 1.

As illustrated in FIG. 1, a refrigerator according to an embodiment of the present invention includes a cabinet 1 that defines an external appearance of the refrigerator, and defines a space for storing food items. A vertical partition wall 2 is arranged in the cabinet 1. A freezer compartment 3 and a refrigerator compartment 4 are partitioned from each other by the vertical partition wall 2, so that the freezer compartment 3 is provided on the left side of the refrigerator and the refrigerator compartment 4 is provided on the right side of the refrigerator. A freezer door 5 is hinged to a front of the freezer compartment 3 to open and close the freezer compartment 3, and a storage door 6 is hinged to a front of the refrigerator compartment 4 to open and close the refrigerator compartment 4.

The freezer compartment 3 is maintained at a temperature between −16° C. and −21° C. so as to keep foods, such as meat, fish, and ice cream frozen. On the other hand, the refrigerator compartment 4 is maintained at a temperature between 3° C. and 5° C., thus keeping foods, such as vegetables, fruits, and beverages, fresh. The freezer compartment 3 and the refrigerator compartment 4 are provided with a plurality of shelves 7 and drawers 8 to effectively store food therein.

Further, the refrigerator according to the present invention is provided with a temperature controlled chamber 20. The temperature controlled chamber 20 stores food which must be maintained at a predetermined temperature between a temperature of the freezer compartment 3 and a temperature of the refrigerator compartment 4.

As illustrated in FIG. 2, a compressor 9, an evaporator 10, and a blowing fan 11 are mounted to an upper portion of the refrigerator compartment 4 to cool an interior of the refrigerator compartment 4. A guide duct 12 is provided in a rear portion of the refrigerator compartment 4, so that air is guided to the evaporator 10 after being circulated in the refrigerator compartment 4.

According to the present invention, the temperature controlled chamber 20 is provided in a lower portion of the refrigerator compartment 4, and is partitioned from the refrigerator compartment 4. The temperature controlled chamber 20 is mainly cooled by cool air fed from the freezing compartment 3, in place of cool air circulating in the refrigerator compartment 4, and is thereby maintained at the predetermined temperature between the temperature of the freezer compartment 3 and the temperature of the refrigerator compartment 4.

Figure 3:
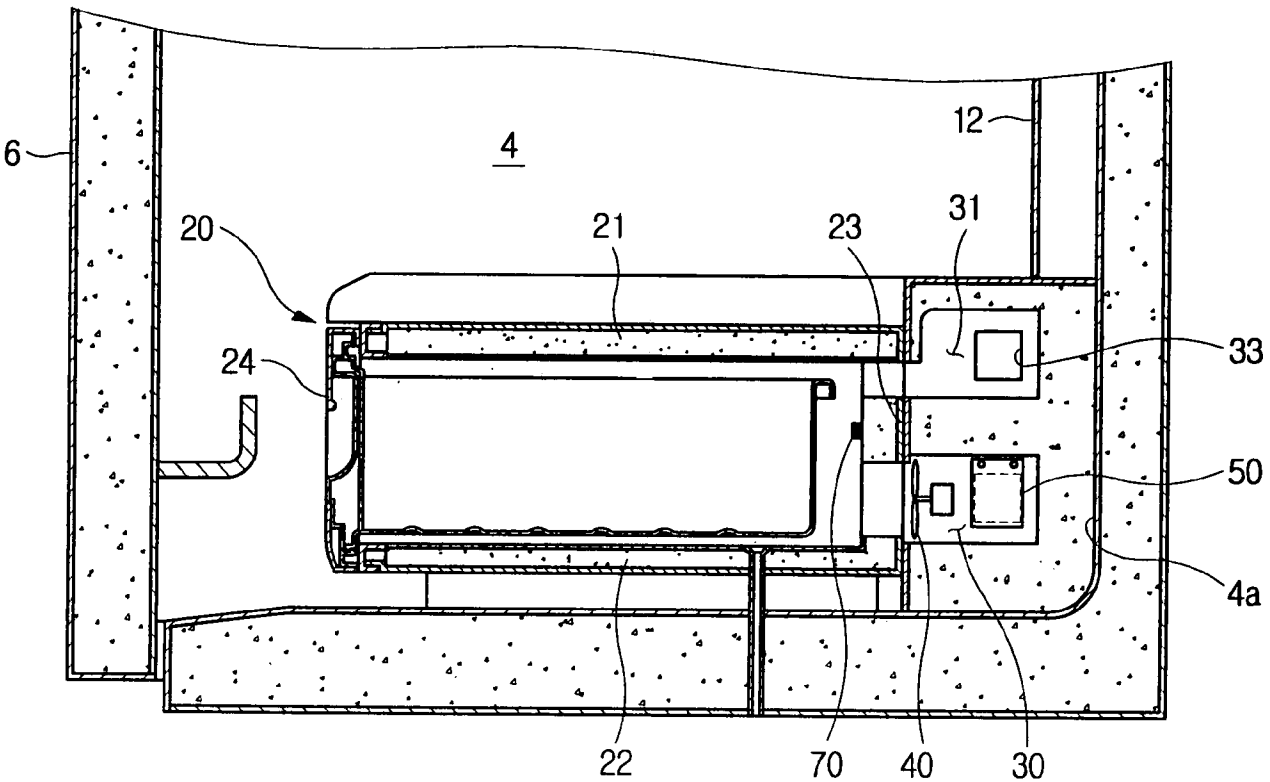
FIG. 3 is a sectional view of a temperature controlled chamber installed in a refrigerator compartment of the refrigerator of FIG. 1, with an intake damper being closed.
Figure 4:
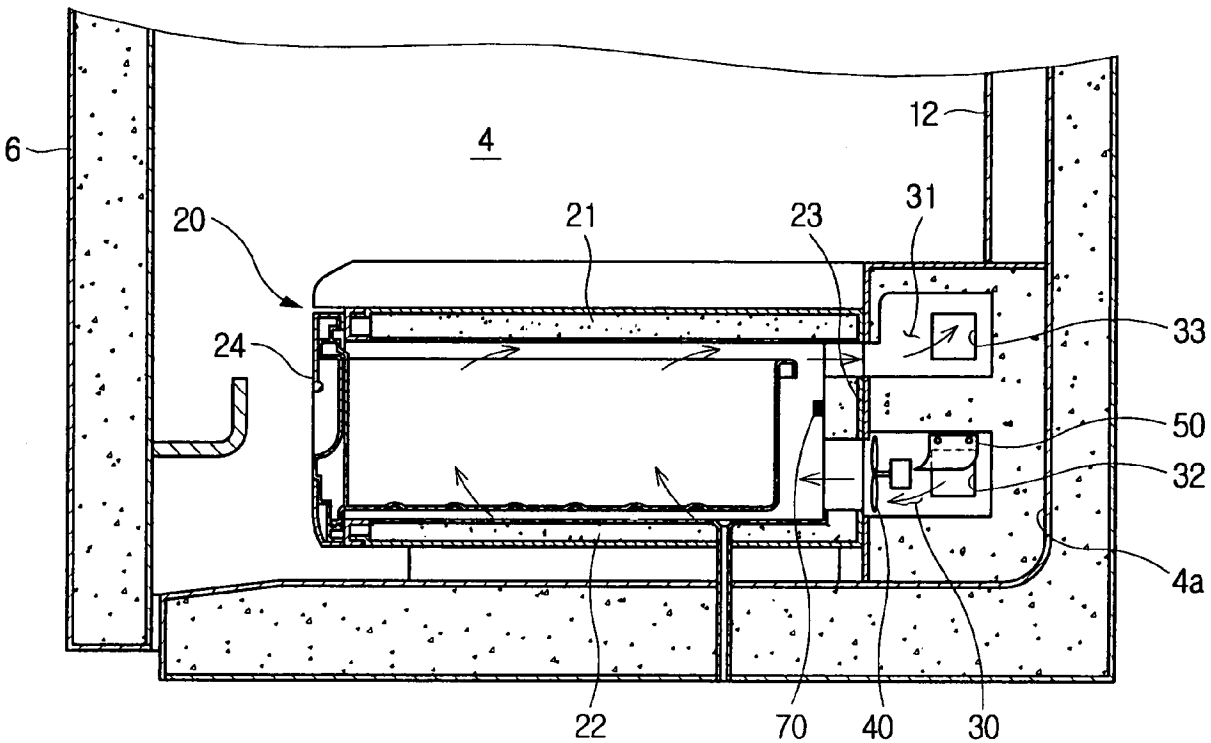
FIG. 4 is a sectional view of the temperature controlled chamber installed in the refrigerator compartment of the refrigerator of FIG. 1, with the intake damper being opened.
Figure 5:
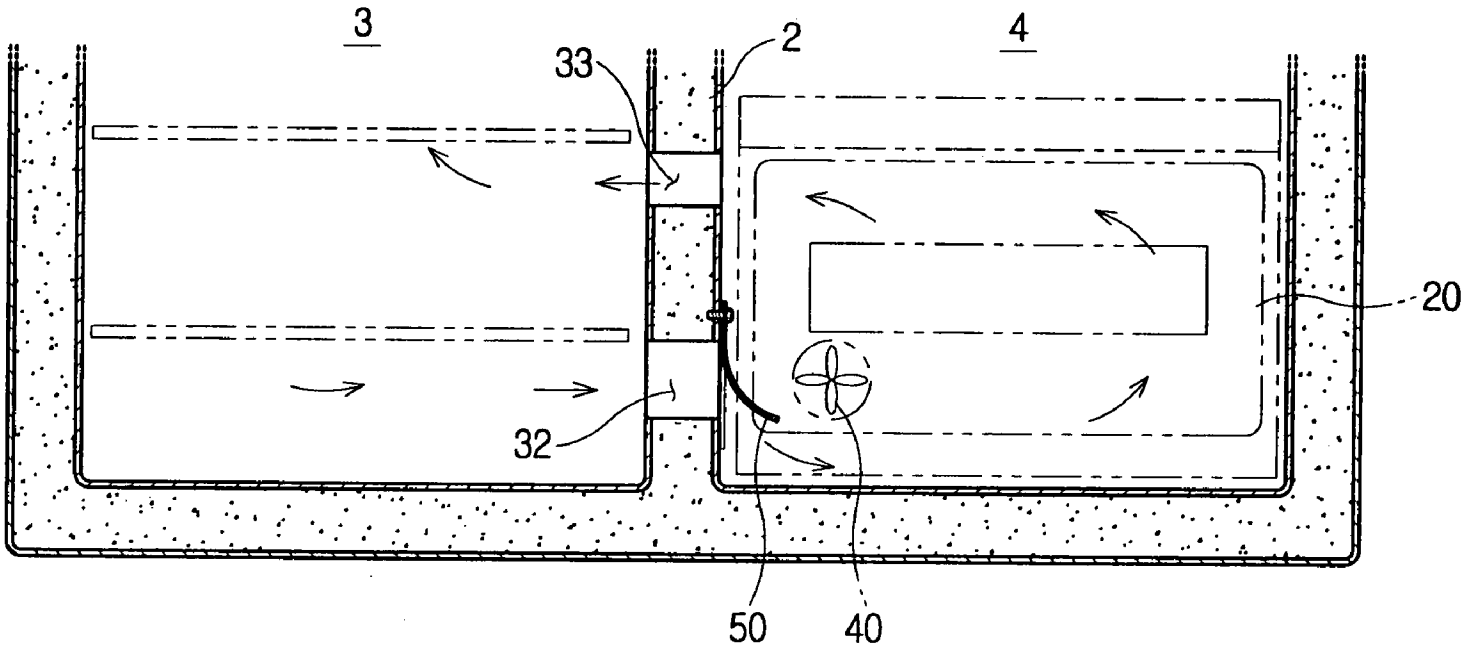
FIG. 5 is a schematic sectional view illustrating flow of cool air between a freezer compartment and the temperature controlled chamber included in the refrigerator of FIG. 1.

FIG. 3 is a sectional view of the temperature controlled chamber, with an intake damper closed. FIG. 4 is a sectional view of the temperature controlled chamber with the intake damper open. FIG. 5 is a schematic sectional view illustrating flow of cool air between the freezer compartment and the temperature controlled chamber 20.

As illustrated in the drawings, the temperature controlled chamber 20 has an upper insulation wall 21, a lower insulation wall 22, side insulation walls (not shown), and a rear insulation wall 23, and has a box shape which is opened at a front thereof. A drawer 24 for storing food items therein is put into the temperature controlled chamber 20 to move forward and backward.

A cool air intake passage 30 and a cool air discharging passage 31 are provided between the rear insulation wall 23 of the temperature controlled chamber 20 and a rear wall **4*a* of the refrigerator compartment 4 to circulate cool air from the freezer compartment 3 to the temperature controlled chamber 20**.

The temperature controlled chamber 20 is cooled by cool air fed from the freezer compartment 3. To cool the temperature controlled chamber 20 by the cool air fed from the freezer compartment 3, as illustrated in FIG. 5, a cool air inlet port 32 and a cool air outlet port 33 are bored in the vertical partition wall 2 which partitions the cabinet 1 into the freezer compartment 3 and the refrigerator compartment 4.

Further, according to one aspect, a cooling fan 40 is installed in the cool air intake passage 30 to forcibly circulate cool air from the freezer compartment 3 through the cool air inlet port 32 to the temperature controlled chamber 20. An intake damper 50 is mounted to the vertical partition wall 2 at a side around the temperature controlled chamber 20 to open and close the cool air inlet port 32. According to another aspect, the cooling fan 40 is installed in the freezer compartment 3. According to yet another aspect, the cooling fan 40 is installed in the cool air inlet port 32.

Since the intake damper 50 has a flexible thin plate, and is fixed at an upper end thereof to the vertical partition wall 2, the intake damper 50 is upwardly moved at a lower end thereof by cool air pulled in by the cooling fan 40, and returns to an original position, thus opening and closing the cool air inlet port 32.

More specifically, in the case where the cooling fan 40 is not operated, the cool air inlet port 32 is closed by the intake damper 50. When cool air flows into the temperature controlled chamber 20 by an operation of the cooling fan 40, the lower end of the intake damper 50 is upwardly moved, thus opening the cool air inlet port 32. Meanwhile, when flow of the cool air is stopped by a stoppage of the cooling fan 40, the lower end of the intake damper 50 is returned to an original position thereof, in close contact with the cool air inlet port 32 due to gravity acting on the flexible intake damper 50, thereby closing the cool air inlet port 32.

That is, the intake damper 50 opens and closes the cool air inlet port 32 by the flow of the cool air, without an additional drive device, thereby conserving power, in addition to preventing a generation of noise.

Further, a temperature sensor 70 is mounted in the temperature controlled chamber 20 to control operation of the cooling fan 40, thus allowing an interior of the temperature controlled chamber 20 to be maintained at a predetermined temperature.

The cool air inlet port 32 is closed by the intake damper 50, as illustrated in FIG. 3. In such a state, when the cooling fan 40 is operated, cool air flows into the temperature controlled chamber 20. At this time, the intake damper 50 is upwardly moved at the lower end thereof to open the cool air inlet port 32, as illustrated in FIG. 4.

As illustrated in FIG. 5, cool air is fed from the freezer compartment 3 through the cool air inlet port 32 to the cool air intake passage 30 to circulate in the temperature controlled chamber 20. Subsequently, the cool air is discharged through the cool air discharging passage 31 and the cool air outlet port 33 into the freezer compartment 3. Through such a process, the interior of the temperature controlled chamber 20 is cooled.

Cool air is circulated from the freezer compartment 3 to the temperature controlled chamber 20 for a predetermined period of time, and the temperature sensor 70 senses whether the temperature controlled chamber 20 has reached a preset temperature. When the temperature sensor 70 senses that the temperature controlled chamber 20 has reached the preset temperature, the cooling fan 40 is stopped. Thus, the flow of cool air is stopped, and the intake damper 50 closes the cool air inlet port 32.

By repeating such a process, the interior of the temperature controlled chamber 20 is controlled to have a predetermined temperature between a temperature of the freezer compartment 3 and a temperature of the refrigerator compartment 4.

Thus, by controlling an operation of the cooling fan 40, meat or fish is freshly stored at a predetermined temperature between −3° C. to −5° C., thus allowing the meat or fish to be immediately cooked without the necessity of being thawed. Of course, it is possible to store other food items, which must be stored at a predetermined temperature in addition to the meat or fish, in the temperature controlled chamber 20.

As is apparent from the above description, the present invention provides a refrigerator having a temperature controlled chamber which is designed to be maintained at a predetermined temperature between a temperature of a freezer compartment and a temperature of a refrigerator compartment, thus maintaining the freshness of food items, such as meat and fish, without freezing the food items and thereby allowing the food items to be immediately cooked without thawing the food items, and therefore allowing the food items to be rapidly cooked.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a refrigerator compartment maintained at a predetermined refrigerator temperature;

a freezer compartment maintained at a predetermined freezer temperature;

a temperature controlled chamber provided in the refrigerator compartment, partitioned from a remainder of the refrigerator compartment;

a cool air inlet port to introduce cool air from the freezer compartment into the temperature controlled chamber;

a cool air outlet port to discharge the cool air from the temperature controlled chamber into the freezer compartment;

a cooling fan positioned adjacent to the cool air inlet port, to forcibly circulate the cool air from the freezer compartment to the temperature controlled chamber; and an intake damper installed in the cool air inlet port to open and close the cool air inlet port, the intake damper comprising a thin plate that opens the cool air inlet port in response to the cool air flowing into the temperature controlled chamber when the cooling fan is operated, and closes the cool air inlet port in response to a stoppage of flow of the cool air when the cooling fan is stopped.

2. The refrigerator according to claim 1, wherein the temperature controlled chamber has an opening at a front, and comprises:

a rear insulation wall;

upper and lower insulation walls;

side insulation walls; and a drawer to store food items movable through the front opening.

3. The refrigerator according to claim 2, wherein:

the refrigerator compartment and the freezer compartment are partitioned from each other by a vertical partition wall arranged between the refrigerator and freezer compartments; and the cool air inlet port and the cool air outlet port are located in the vertical partition wall, so that the cool air is circulated between the freezer compartment and the temperature controlled chamber through the cool air inlet and outlet ports.

4. The refrigerator according to claim 1, further comprising:

a temperature sensor mounted in the temperature controlled chamber to control operation of the cooling fan, operating the fan when a first temperature of the temperature controlled chamber rises above a predetermined temperature, and stopping fan operation when the first temperature reaches the predetermined temperature.

5. The refrigerator according to claim 4, wherein:

the predetermined temperature is between the predetermined refrigerator temperature and the predetermined freezer temperature.

6. A refrigerator, comprising:

a refrigerator compartment;

a freezer compartment;

a chamber partitioned from the refrigerator and freezer compartments;

a fan to forcibly circulate air from the freezer to the chamber; and a port to exchange air between the freezer compartment and the chamber, the port comprising an inlet port to introduce air from the freezer into the chamber, an outlet port to discharge air from the chamber into the freezer, and an intake damper that selectively opens and closes the inlet port by the flow of air, without an additional drive device.

7. The refrigerator according to claim 6, wherein the chamber comprises:

a drawer that moves in and out of the chamber to store food items.

8. The refrigerator according to claim 6, wherein:

the fan is positioned adjacent to the inlet port.

9. The refrigerator according to claim 8, wherein:

the fan is positioned in the chamber.

10. The refrigerator according to claim 8, wherein:

the fan is positioned in the freezer.

11. The refrigerator according to claim 6, wherein:

the fan is positioned in the inlet port.

12. A refrigerator, comprising:

a refrigerator compartment;

a freezer compartment;

a chamber partitioned from the refrigerator and freezer compartments; and a port to exchange air between the freezer compartment and the chamber, the port comprising an inlet port to introduce air from the freezer into the chamber;

an outlet port to discharge air from the chamber into the freezer a fan positioned adjacent to the inlet port to forcibly circulate air from the freezer to the chamber, and an intake damper to selectively open and close the inlet port, wherein the intake damper comprises a plate that opens and closes the inlet port in response to air flow from the freezer.

13. The refrigerator according to claim 12, wherein:

the plate is hinged at a first end to rotate the plate to open and close the inlet port in response to air flow from the freezer.

14. The refrigerator according to claim 12, wherein:

when the fan operates, air flows from freezer and moves the plate, thereby opening the inlet port.

15. The refrigerator according to claim 14, wherein the chamber further comprises:

a temperature sensor that operates the fan when a sensed temperature is above a predetermined temperature.

16. The refrigerator according to claim 15, wherein:

the predetermined temperature is between a freezer temperature and a refrigerator temperature.

17. An apparatus with a refrigerator compartment and a freezer compartment, comprising:

a temperature controlled chamber, cooled by air from the freezer compartment, and maintained at a predetermined temperature between a temperature of the refrigerator compartment and a temperature of the freezer compartment;

an inlet port channeling the air from the freezer into the temperature controlled chamber; and an intake damper opening and closing the intake port by the flow of air, without an additional drive device.

* * * * *